United States Patent [19]

Haigh et al.

[11] Patent Number: 4,771,751

[45] Date of Patent: Sep. 20, 1988

[54] FUEL RAIL

[75] Inventors: Matthew Haigh, Chelmsford; Martin J. D. Herbert, Great Waltham; William J. J. O'Leary, Chelmsford, all of United Kingdom

[73] Assignee: Ford Motor Company, Dearborn, Mich.

[21] Appl. No.: 43,280

[22] Filed: Apr. 27, 1987

[30] Foreign Application Priority Data

May 3, 1986 [GB] United Kingdom ..... 8610904

[51] Int. Cl.[4] ..... F02M 55/00

[52] U.S. Cl. ..... 123/470; 123/468

[58] Field of Search ..... 123/470, 472, 432, 468, 123/52 M, 52 MV, 52 R, 52 MC

[56] References Cited

U.S. PATENT DOCUMENTS 4,243,000 1/1981 Yamada ..... 123/432 X
4,381,749 5/1983 Sugiyama ..... 123/432
4,556,034 12/1985 Anklam et al. ..... 123/470
4,563,984 1/1986 Ziegler et al. ..... 123/52 M

FOREIGN PATENT DOCUMENTS 0132418 5/1984 European Pat. Off. .
3511382 10/1985 Fed. Rep. of Germany ..... 123/432

*Primary Examiner*—Tony M. Arganbright
*Assistant Examiner*—Eric R. Carlberg
*Attorney, Agent, or Firm*—Robert E. McCollum; Clifford L. Sadler

[57] ABSTRACT

A fuel rail is defined by a spacer member sandwiched between a throttle body and an engine intake manifold, the spacer member having air channels connecting the throttle body air induction passages to the manifold inlet bores, the spacer member also having at least one longitudinal bore constituting a fuel passage, and fuel injector receiving cups communicating with the fuel passages.

2 Claims, 5 Drawing Sheets

FUEL RAIL

This invention relates to a fuel rail for conveying fuel to the injectors of a fuel injected engine and in particular on a V-configuration engine.

Fuel integrity, i.e., a complete absence of any fuel leakages between the fuel rail and the injectors, is of the utmost importance. Conventionally, fuel rails have been made by fabrication of sheet metal components. It will be apPreciated that in a V-configuration engine, the injectors for one bank of cylinders will be at an angle to the injectors in the other bank, and that the cups which form part of the rail and receive the ends of the injectors must therefore be correspondingly positioned at individually determined angles. In order to ensure fuel integrity, the angle of the cups where they are mounted on the rail must be accurately determined, and this is difficult when the rail is fabricated.

For in-line engines, it is known (see European Patent Specification No. 0 132 418) to construct a fuel rail as a single-piece aluminum stamping which is subsequently machined in order to provide the necessary mating surfaces for the injectors and for the fuel inlets and other connections. However, it would not be possible, for manufacturing reasons, to construct a stamped rail to duplicate the fuel paths currently provided in a fabricated rail for a V-configuration engine with centrally located air inlet tracts positioned between the banks.

According to the invention, there is provided a fuel rail for a V-configuration engine, the rail comprising a spacer body adapted to be located between an air plenum and the inlet manifold of the engine and having air passages therethrough to connect the plenum and the manifold, at least one longitudinal bore which defines a fuel passage extending through the spacer body, and a plurality of fuel injector cups projecting from the spacer body and communicating with the fuel passage.

The spacer body can comprise a number of separate spacer members joined together by a rail member or members through which the fuel passage runs.

Where the engine has centrally located air inlet tracts, a single longitudinal bore positioned centrally above the engine can provide the fuel passage so that it is possible to use a single, straight passage to serve the cups for the injectors on both banks of the engine.

In an alternative embodiment, there may be two parallel longitudinal bores, connected by cross drillings at each end, so that two rows of injectors can be served by the one rail.

The rail can be manufactured as an aluminum stamping with subsequent machining to define the internal contours of the cups. This allows the cup positions to be defined much more accurately than was possible with the fabricated manifold.

Additionally, the location of the rail member in spacer members which will be bolted between the plenum and the inlet manifold means that the position of the rail is very accurately defined, and there is no possibility of misalignment occurring either during assembly or during servicing.

When there is a single, central longitudinal passage and a plurality of spacer members, the rail member preferably forms a dividing wall in the air passage through each spacer member, so that separation between the air passages from the plenum is maintained.

The invention will now be further described, by way of example, with reference to the accompanying drawings in which.

Figure 1:
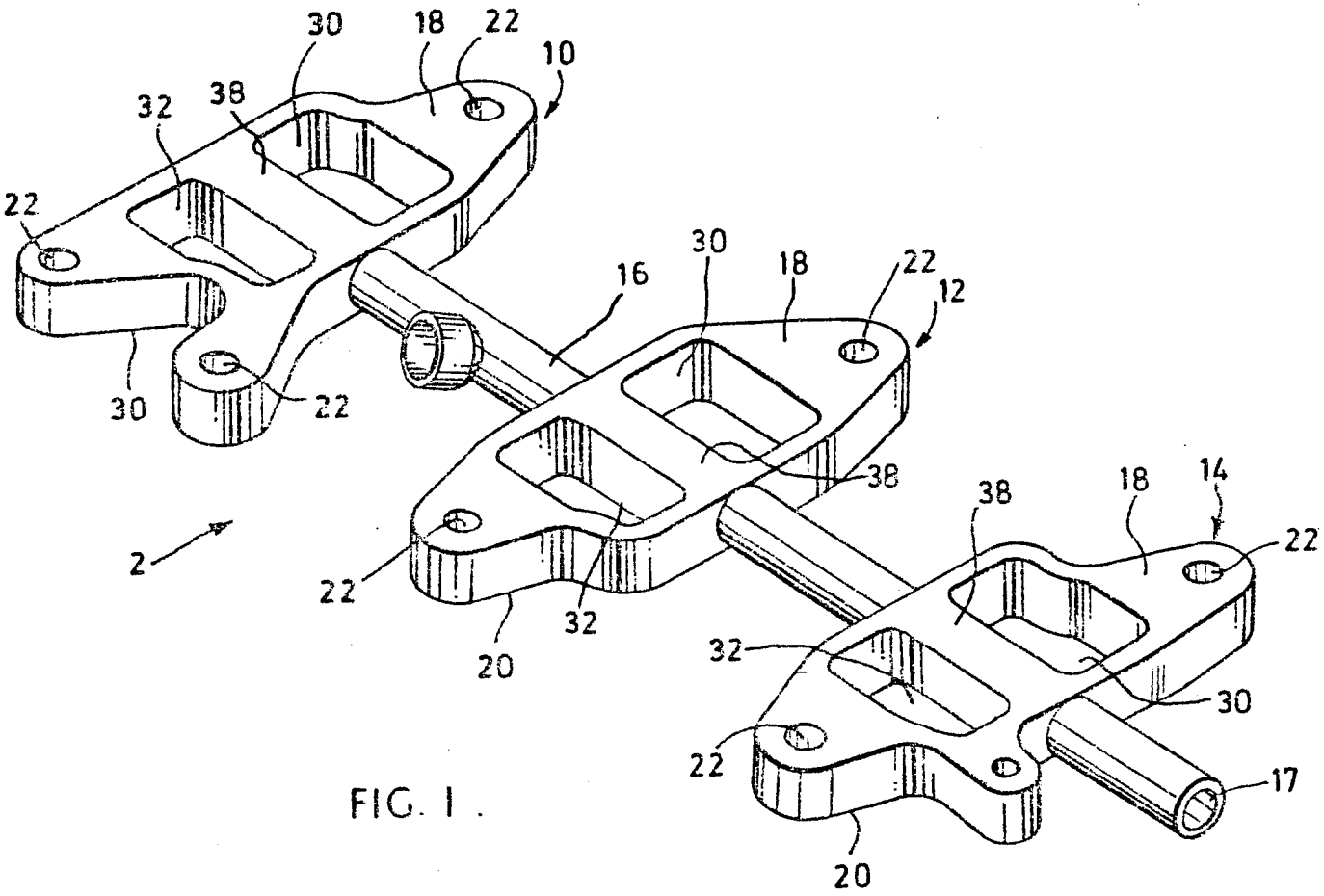
FIG. 1 is an isometric view of a fuel rail in accordance with the invention, but showing only one out of the six cups which are actually needed.

FIG. 1 shows a rail 2 for a V6 engine, the rail having three spacer members 10, 12 and 14. The latter are connected to one another by a tubular rail member 16 defining a fuel passage extending through and between the spacers. The member 16 will have a continuous bore 17 through its length, and the usual fuel inlet and fuel return connections (not shown) will be made to the tube. The right-hand end of the tube 16 is shown open to illustrate the bore 17. However, in practice, the bore 17 will stop short of one end of the tube and be closed by a sealing plug at the other end.

Each spacer has an upper surface 18 and a lower or undersurface 20. These surfaces are flat, and may be machined if necessary to achieve a truly flat face. The spacers have holes 22 through which fastening bolts can extend.

Figure 4:
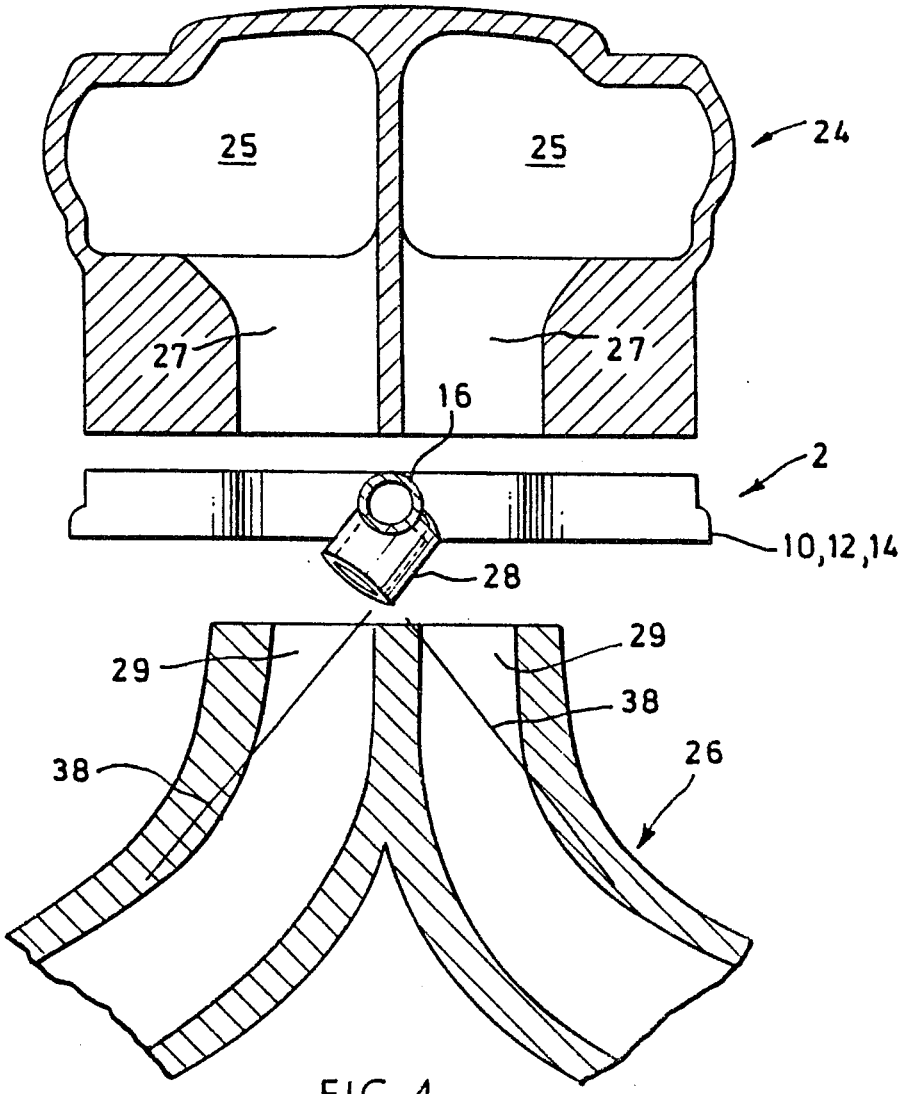
FIG. 4 is a section through the rail shown in juxtaposition with a plenum chamber and an inlet manifold, and indicating the attitude of one of the fuel injectors.

FIG. 4 shows the rail 2 mounted between an air plenum 24 and an engine inlet manifold 26. The plenum 24 has an upper chamber region 25 from which air channels 27 extend downwardly to convey air for engine combustion to inlet passages 29 in manifold 26. Conventionally, the channels 27 would lead directly into passages 29, with a gasket between the respective metal surfaces. The externally mounted fuel rail then would be the usual generally E-shaped rail with the limbs or legs of the E carrying injector cups at the ends of the legs and projecting into the spaces between the air channels 27 to connect to the injectors.

In the construction in accordance with the invention, as shown in FIG. 4, the downwardly extending channels 27 are shortened by the thickness of the spacer members, for example 14mm, and the parts of the channels which have been removed are replaced by the tubular rail 2 including spacers 10, 12 and 14. Gaskets (not shown) will be provided both above and below the rail to close and seal the air passages between the plenum and the manifold.

Figure 2:
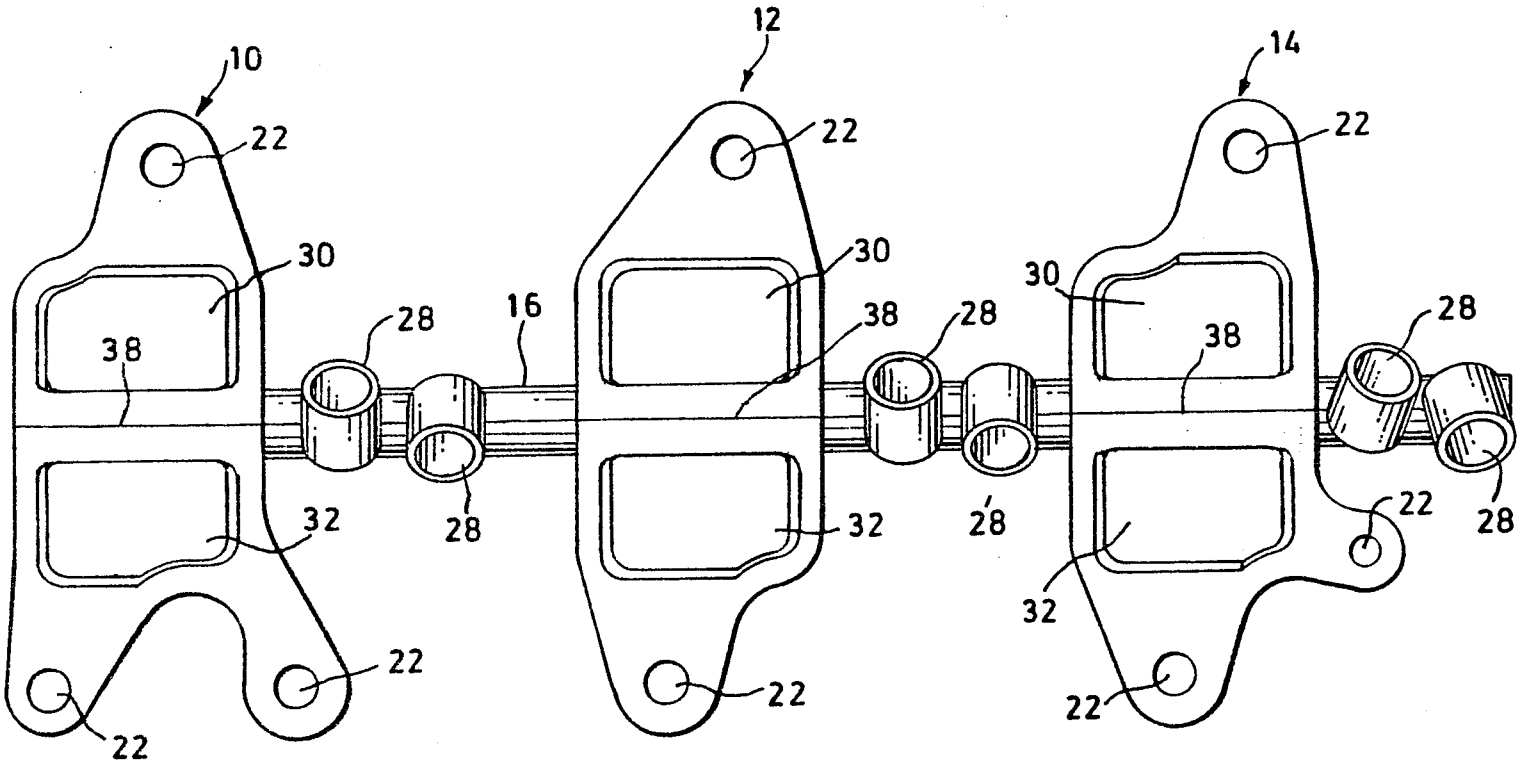
FIG. 2 is a plan view of the fuel rail with six cups.
Figure 3:
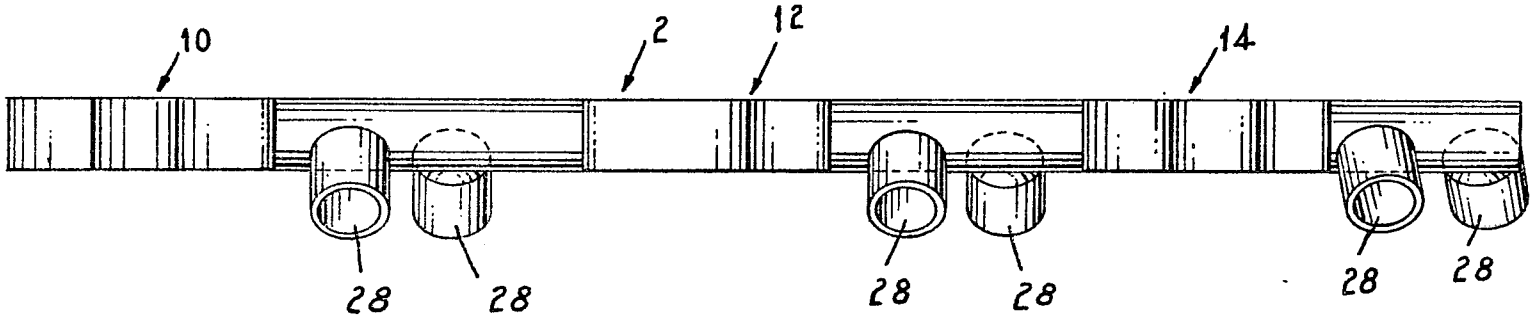
FIG. 3 is a side view of FIG. 2.

For connection with fuel injectors (not shown) that would be mounted in sockets in the manifold 26, injector cups 28 are formed on those portions of member 16 that extend between the spacer members. In FIG. 1, only one of these cups is shown, but in practice, there will be five additional cups, one next to the one shown, two between the spacer members 12 and 14, and two to the right of the spacer member 14. All six cups are shown in FIGS. 2 and 3.

Each spacer member has two through induction air passages 30 and 32 which allow air to pass from the plenum 24 into the respective manifold inlet passages 29. The passages 30 and 32 are separated by a wall 38, which can have any suitable cross-sectional shape so long as sufficient material is available to form continuous walls for the bore 17. It will be preferable for the wall to be shaped with reference to the shape of the passages 30 and 32 so that no unnecessary restriction to air flow occurs and so that an effective seal can be provided between the passage 27, 30 and 29 and the passage 27, 32 and 29.

The whole rail 2 can be formed in one piece by a known aluminum stamping process. After stamping, a machining step will occur which involves a boring operation to form a continuous passage for the length of the rail down the center of the member 16, and subsidiary boring operations to form the injector seats in the cups 28. This machining, together with the formation of the necessary inlet and outlet connections, is described in EP-PS No. 0 132 418. It may also be necessary to machine the faces 18 and 20 of each spacer member so that the associated gaskets can provide and maintain a good seal between the adjacent components.

In FIG. 4, the location of two of the injectors is indicated by their center line 38.

To assemble this rail to an engine, the injectors are first mounted in their respective cups 28 in the fuel rail. The rail is then lowered onto the manifold, with the bores 22 locating on studs or registering with corresponding tapped bores in the manifold, and the injectors manipulated into place in the inlet manifold sockets. A gasket is placed on the top of the rail (there is also a gasket between the rail and the manifold) and the plenum 24 then lowered and fastened down to the manifold, thus trapping and sealing the spacer members and the rail in place on the head.

Figure 5:
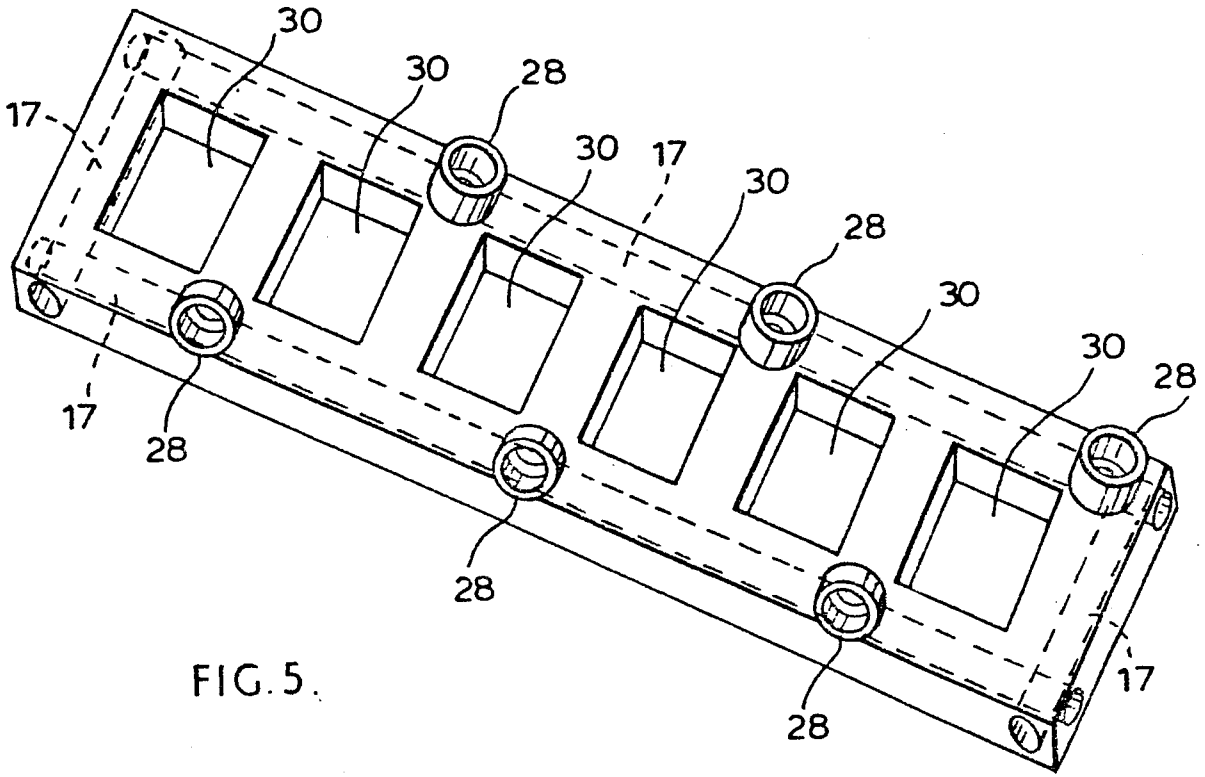
FIG. 5 is a perspective view of an alternative embodiment with parallel bores.

FIG. 4 shows a single, centrally located longitudinal bore for the fuel passage where the engine has centrally located air inlet passages. FIG. 5 shows the construction of a fuel rail with parallel longitudinal bores connected by cross drillings at each end, so that two rows of injectors can be served by the one rail.

While the invention has been shown and described in its preferred embodiments, it would be clear to those skilled in the arts to which it pertains that many changes and modifications may be made thereto without departing from the scope of the invention.

We claim:

1. A fuel rail for a V-configuration automotive type internal combustion engine having a throttle body superimposed over an intake manifold, the throttle body having an air plenum above an induction channel aligned with a throttle bore passage in the manifold for flow of air to the engine cylinders, the rail including a spacer body mounted sealingly between the throttle body and the manifold of the engine and having air induction passages therethrough to connect the throttle body channels and the manifold, the spacer body having at least one longitudinal bore defining a fuel passage extending through the spacer body, and a plurality of fuel injector receiving cups projecting from and communicating with the fuel passage, the spacer body comprising a number of separated spacer members, and rail member means through which the fuel passage runs joining the spacer members together, the rail member means forming a dividing wall in the air passage through each spacer member providing separate air passages from the plenum.

2. A fuel rail for a V-configuration automotive type internal combustion engine having a throttle body superimposed over an intake manifold, the throttle body having an air plenum above an induction channel aligned with a throttle bore passage in the manifold for flow of air to the engine cylinders, the rail including a spacer body mounted sealingly between the throttle body and the manifold of the engine and having air induction passages therethrough to connect the throttle body channels and the manifold, the spacer body having at least one longitudinal bore defining a fuel passage extending through the spacer body, and a plurality of fuel injector receiving cups projecting from and communicating with the fuel passage, the spacer body comprising a number of separated spacer members, and rail member means through which the fuel passage runs joining the spacer members together, the fuel passage being a single longitudinal bore including the rail member means and being positioned centrally above the engine providing a single straight passage for the fuel to flow to cups for the injectors on both banks of the engine.

* * * * *